United States Patent [19]

Park

[11] Patent Number: 4,886,274

[45] Date of Patent: Dec. 12, 1989

[54] PORTABLE PRACTICING PUTTING GREEN

[76] Inventor: Young Go Park, Apartment #KA-305 Dong-A Apartments, No. 902 Dachi-dong, Dachi-dong Kangnam-ku, Seoul 135-280, Rep. of Korea

[21] Appl. No.: 212,704

[22] Filed: Jun. 28, 1988

[30] Foreign Application Priority Data

Nov. 24, 1987 [KR] Rep. of Korea ..... 20342[U]

[51] Int. Cl.[4] ..... A63B 67/02

[52] U.S. Cl. ..... 273/176 FB; 273/177 B; 273/176 J; 273/181 K

[58] Field of Search ..... 273/192, 176 J, 179 A, 273/122 A, 122 R, 34 R, 182 R, 181 R, 177 R, 177 A, 177 B, 125 R, 179 R–179 D, 176 B, 181 K, 407, 406, 410, 127 C, 162 R–162 F, 180, 87 B, 87 C; 313/41; 248/575, 603

[56] References Cited

U.S. PATENT DOCUMENTS

| | | | |
|---|---|---|---|
| 3,342,495 | 5/1965 | Wasley | 273/179 R |
| 4,160,550 | 7/1979 | Barrett | 273/177 B |
| 4,227,112 | 10/1980 | Waugh et al. | 313/41 |
| 4,230,319 | 10/1980 | Lindner | 273/176 FB |
| 4,249,739 | 2/1981 | Brandell | 273/179 A |
| 4,368,888 | 1/1983 | Ren | 273/176 FB |

FOREIGN PATENT DOCUMENTS

| | | |
|---|---|---|
| 58-4522 | 1/1983 | Japan . |
| 58-6457 | 2/1983 | Japan . |
| 60-25280 | 7/1985 | Japan . |
| 61-18918 | 6/1986 | Japan . |
| 61-39504 | 11/1986 | Japan . |

OTHER PUBLICATIONS

*The Sporting Goods Dealer,* "Realistic Green for Indoor Golf", Apr. 1972.

*Primary Examiner*—Edward M. Coven
*Assistant Examiner*—Dean Small
*Attorney, Agent, or Firm*—Fleit, Jacobson, Cohn, Price, Holman & Stern

[57] ABSTRACT

A portable practicing putting green 44 having a putting surface band 11, a cup 91 at one end of it, a square angle 22 on the other end of it, and a rebound bar 32 replacably put on either side of the square angle or near the hole, for rebounding golf ball 47. The square angle 22 is bolted to one end of the putting surface band 11 and to its standing side is outwardly bonded a rubber plate 27 which is perpendicular to the center line 17 of the putting surface band 11. The rebound bar has four exposed planar side surfaces 31, 35, 37, 39 with three 35, 37, 39 of them bonded to a thin, medium, and thick rubber plates, respectively to provide different rebounding forces, and the remaining exposed 31 remaining bare. When it is being carried or stored, the rebound square bar is put in between the inner sides of the square angle 22 and the square angle and rebound bar 32 are wound up inside putting surface band 11 to minimize its volume.

12 Claims, 4 Drawing Sheets

PORTABLE PRACTICING PUTTING GREEN

BACKGROUND OF THE INVENTION

1. Field of the Invention

This invention relates to a portable practicing putting green used for practicing the art of putting a golf ball with a golf putter.

2. Background Art

On a putting green of a golf course, putting requires precise skill in application of putting direction and force. References such as Japanese Utility Model Publication Nos. 58-64457 (83.2.3), 61-39504 (86.11.12.), 60-25280 (85.7.27.) and 61-18918 (86.6.7), as well as U.S. Pat. Nos. 4,230,319, 4,227,112, 4,368,888 and 4,249,739 endeavor in various ways to provide portable practice putting greens.

These portable practicing putting greens generally have a putting surface and a cup or small rebound block. Such structures have disadvantages due to their size, which is relatively large, and which makes it difficult to carry or store them. Moreover, the putting distance these structures provide is relatively short, thus minimizing opportunity for observing and evaluating putting direction, prevention of a "head up" stance while putting cannot be easily practiced; and practice of putting with a golf ball could not be repeatedly and consecutively done.

SUMMARY OF THE INVENTION

Accordingly, an object of the present invention is to provide an improved putting green. It is another object to provide a portable practicing putting green having a size limited to about 3 inches in diameter and about 10 inches in length, or longer, while it is being carried or stored.

It is still another object of this invention to provide a portable putting green on which any putting distance from a few inches to about 120 feet could be practiced, either indoors or out of doors.

It is a further object of this invention to provide a portable putting green which easily permits observation of putting direction at various putting distances.

It is still another object of this invention to provide a portable putting green that enables a golfer during putting practice to avoid a "head up" stance.

It is yet another object of this invention to provide a portable putting green that enables repeated and consecutive putting with a golf ball.

Still another object of this invention is to provide a portable practicing putting green with a hole located at the end of a carpet where a square angle is not located.

It is a still further object of this invention to provide said portable practicing putting green which contains every advantage of the above objects.

DESCRIPTION OF THE PREFERRED EMBODIMENT

Figure 1:
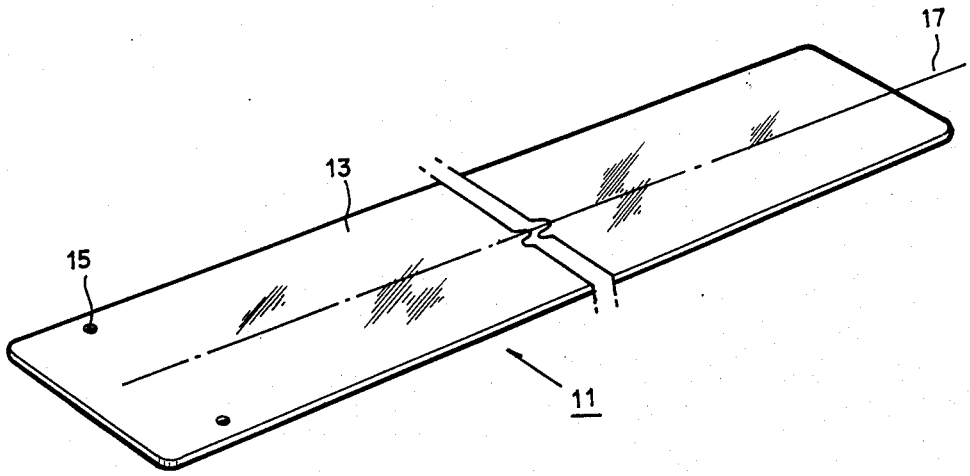
FIG. 1 is a perspective view of a putting surface band used in the practice of this invention.

FIG. 1 shows the putting surface band 11 which is long and band-like, and made of good flexible carpet or artificial lawn, or organic or inorganic cloth 13. One end of band 11 has two bolt holes 15 on opposite sides of a line perpendicular to the center line 17 of the putting surface band 11. Band 11 is 5 to 6 feet in length and about 10 inches in width.

Figure 2:
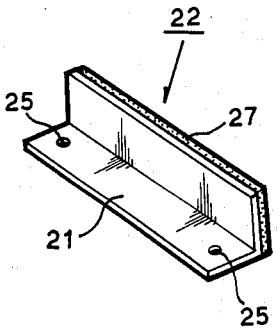
FIG. 2 is a perspective view of a square angle used in the practice of this invention.

FIG. 2 shows square angle 22 made of metal such as aluminum angle 21 having one side with two bolt holes 25 at its ends, and a thin rubber plate 27 outwardly bonded to its other side. The square angle 22 is about 10 inches in length, and about one and one-quarter inches in width.

Figure 4:
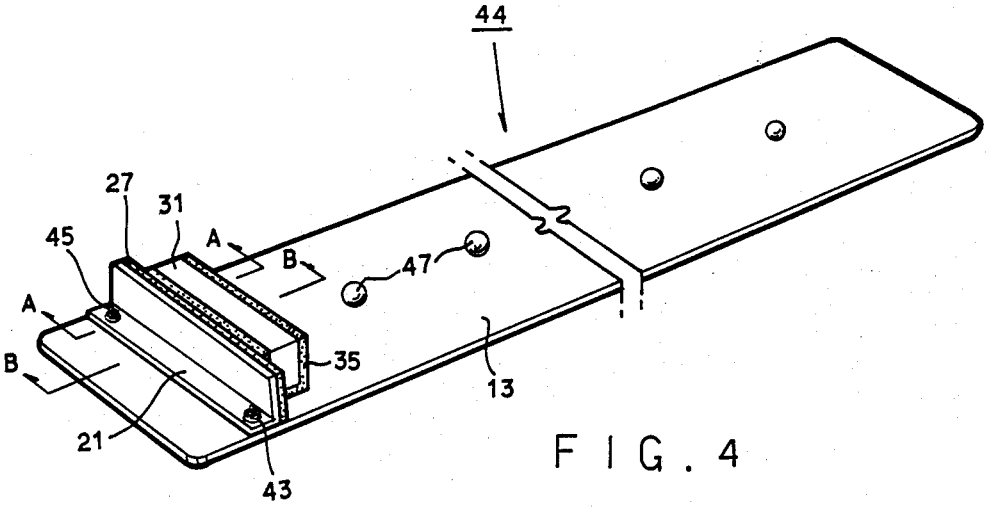
FIG. 4 is a perspective view of a portable practicing putting green constructed according to the principles of this invention.

Bolt holes 15 and bolt holes 25 respectively receive bolts 45, washers 41 and nuts 43 as shown in the FIG. 4 to join one end of band 11 to the exterior of the one side of angle 22. In this case, square angle 22 must be perpendicular to the center line 17 of putting surface band 11. In order to easily adjust the position of angle 22 to assume that the exposed surface of rubber plate 27 is perpendicular to center line 17, bolt holes 25 are made bigger than bolt holes 15.

Figure 3:
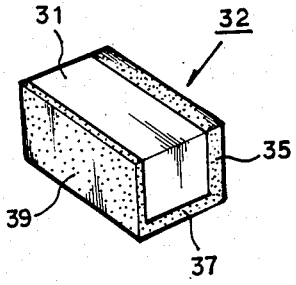
FIG. 3 is a perspective view of a rebound square band used in the practice of this invention.

FIG. 3 shows a rebound bar 32 made of metal such as steel or brass, in the shape of a square bar 31 having one exterior side bounded to about a $\frac{3}{8}$ inch thick rubber plate 35, another exterior side bonded to about a $\frac{1}{4}$ inch thick rubber plate 37, a third side bonded to about 150 inch thick rubber plate 39 and a fourth side left as a bare metal surface. These rubber plates each exhibit between about 30–70 Showa hardness, and slows an intentional slice or hook ball significantly by curving a putted ball rebounded by slowing down the ball's speed while it is being rebounded. The length of the rebound square bar 32 is about 8 inches and its width is about $1\frac{1}{4}$ inches.

As shown in FIG. 4, this rebound square bar 32 is replacably put on the putting surface band 11 adjoining the exposed surface of rubber plate 27 to cause a golf ball 32 to rebound. Any one of the four rebound sides of the rebound square bar 32 may be selected to change the rebounding force of the portable practice putting green.

A beginner golfer will practice putting a golf ball by putting it near to square bar 32, and from time-to-time changing or replacing its side so that he may have all the balls rebounded back, and practice putting with a ball 47 repeatedly and consecutively by observing and evaluating its distance and direction without his "head up".

As the beginner develops his skill, the putting position of the ball 47 will move away from the square bar 32. In case of the greatest distance and with the thickest rubber plate side 35 exposed, the maximum putting distance could be 120 feet or more.

The role of rubber plate 27 between the aluminum angle 21 and the square bar 32 that is of a fender or a bumper.

Figure 5:
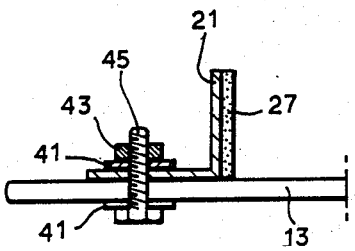
FIG. 5 is a sectional view taken along line A—A of FIG. 4.
Figure 6:
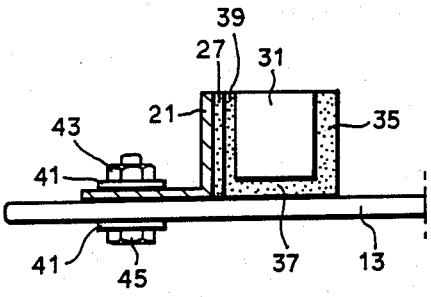
FIG. 6 is a sectional view taken along line B—B of FIG. 4.

FIG. 5 shows the sectional view taken along the line A—A of FIG. 4 for better understanding the structure of this portable practicing putting green, as does FIG. 6, a sectional view taken along the line B—B of FIG. 4.

Figure 7:
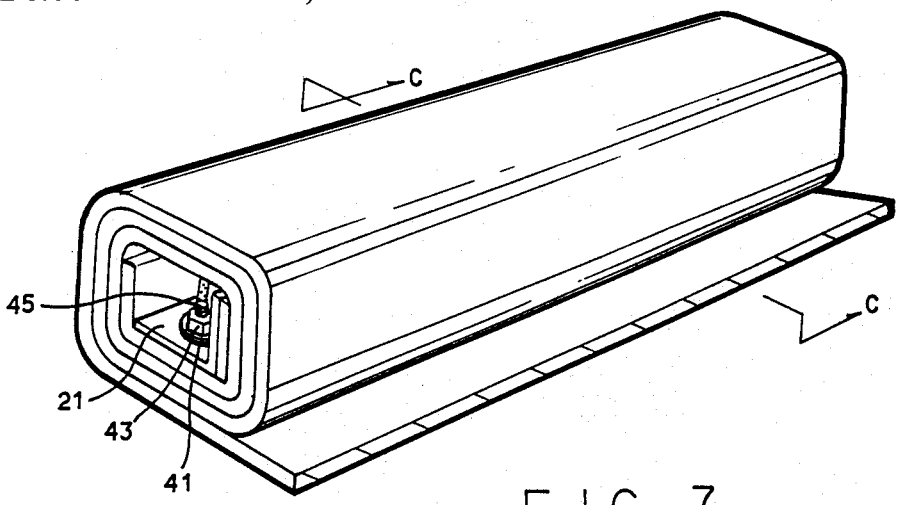
FIG. 7 is a perspective view of the portable practice putting green wound for purposes of being carried or stored.

FIG. 7 shows a perspective view of the present invention that the rebound square bar 32 stowed between interior sides of square angle 22 and the square angle itself 22 being wound up inside the putting surface band 11 while it is being carried or stored to minimize its volume.

Figure 8:
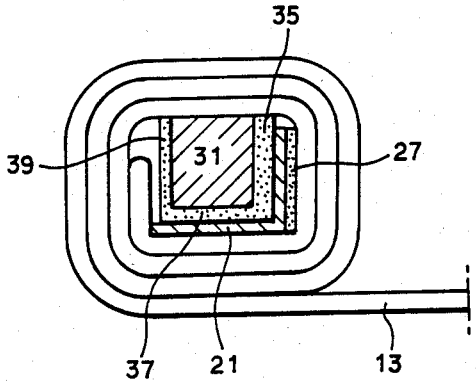
FIG. 8 is a cross-sectional view taken along the line C—C of FIG. 7.

FIG. 8 shows a cross-sectional view taken along line C—C of FIG. 7.

Figure 9:
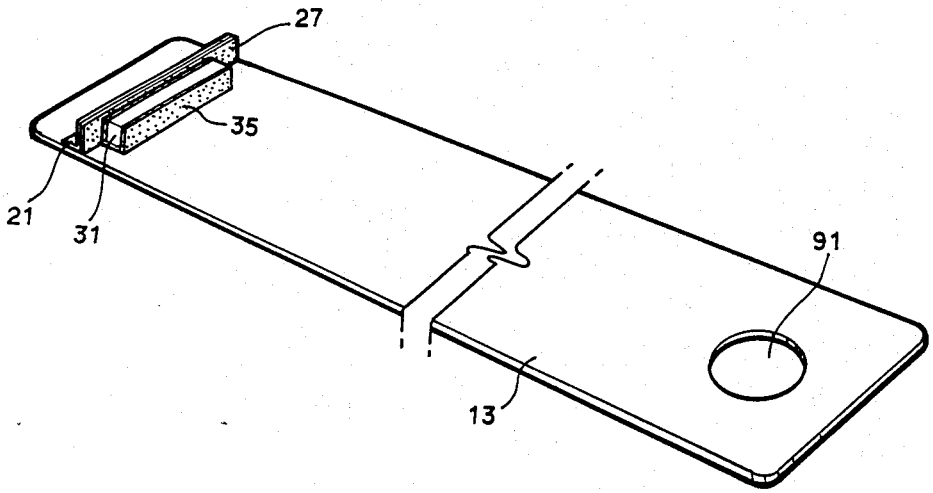
FIG. 9 is a perspective view of another embodiment of this invention with a hole located at the one end of the carpet longitudinally opposite the square angle.

FIG. 9 shows another embodiment of the invention wherein a hole, or cup, 91 having 4¼ inch diameter is provided at the opposite end of the putting direction so that a well putt golf ball could fall into it on rebound. Furthermore, rebound square bar 32 could be moved to the end of said carpet surface band 11 containing hole 91, as is shown in FIG. 9 so that short range putting practicing in another way could be done by putting a golf ball toward hole 91 without the ball running off the surface of band 11. In this case, holes 15 are unnecessary because the rebound square bar 32 is put on the end by its gravity force instead of being tied to any square angle.

What is claimed is:

1. A portable practice putting green for use with a golf ball and golf putter, comprising:

a putting surface band;

a square angle; and a rebound square bar;

said putting surface band being made of flexible material, and having a first two bolt holes at one end thereof which are on a line perpendicular to a center line of said putting surface band;

a first rubber plate;

said square angle being made of a rigid material having one exterior side bonded to said first rubber plate and having a second two bolt holes at an end of another side of said angle, said second bolt holes being bolted together with respective ones of said first bolt holes of said putting surface band;

said rebound square bar being made of metal plated with another metal, and having three of four sides bonded by thin, medium, and thick rubber plates on three sides respectively with its fourth side remaining as a bare metal surface, disposable on said putting surface band and aside said first rubber plate of the square angle to expose a selected one of said four sides and thereby provide varying rebounding forces to a golf ball traveling along said putting surface band toward said rebound square bar.

2. A portable practice putting green as defined in claim 1 wherein said putting surface band is made of flexible carpet, whereby when said rebound bar is disposed on said square angle and between bolts extending through said first and second bolt holes, said square angle may be wound inside said putting surface band to minimize volume of the putting green for storage and carriage.

3. A portable practicing putting green as defined in claim 1 where a cup is located at an end of said putting surface longitudinally opposite the square angle.

4. A portable practice putting green as defined in claim 2, wherein a cup is located at an end of said carpet longitudinally opposite from said one end and the square angle.

5. A portable practice putting green, comprising:

an elongate putting surface made of flexible material and having a first two holes at one end thereof;

a first rubber plate;

an angle made of a rigid material having one exterior side bonded to said first rubber plate and having a second two holes at an end of another side of said angle, said angle being disposed perpendicular across the width of said putting surface with said second holes being aligned with respective ones of said first holes of said putting surface; and a rigid rebound bar having three of four sides bonded by thin, medium, and thick rubber plates on three sides respectively with its fourth side remaining as a bare surface, disposable on said putting surface and aside said first rubber plate of the angle to expose a selected one of said four sides and thereby providing varying rebounding forces to a golf ball traveling along said putting surface toward said rebound bar.

6. The portable practice putting green of claim 5 further comprising a cup located at an end of said putting surface longitudinally opposite the said angle.

7. The portable practice putting green of claim 5 said rebound bar being disposed on said angle and between fasteners extending through said first and second holes whereby said angle may be wound inside said putting surface band to minimize volume of the putting green for storage and carriage.

8. The portable practice putting green of claim 5 further comprising a cup located at an end of said putting surface longitudinally opposite the said angle.

9. The portable practice putting green of claim 5, further comprised of said rebound bar being disposed on said angle and between fasteners extending through said first and second holes, whereby said angle may be wound inside said putting surface band to minimize volume of the putting green for storage and carriage.

10. The portable practice putting green of claim 9, further comprising a cup located at an end of said putting surface longitudinally opposite from said one end and the square angle.

11. The portable practice putting green of claim 9, further comprising a cup located at an end of said putting surface longitudinally opposite from said one end and the square angle.

12. A portable practice putting green, comprising:

an elongate putting surface made of flexible material and having a first two holes at one end thereof;

a first resilient plate;

an angle made of a rigid material having one exterior side bonded to said first resilient plate and having a second two holes at an end of another side of said angle, said angle being disposed perpendicularly across the width of said putting surface with said second holes being aligned with respective ones of said first holes of said putting surface; and a rigid rebound bar having three of four sides bonded by thin, medium, and thick resilient plates on three sides respectively with its fourth side remaining as a bare surface disposable on said putting surface and aside said first resilient plate of the angle to expose a selected one of said four sides and thereby providing varying rebounding forces to a golf ball traveling along said putting surface toward said rebound bar.

* * * * *